US008032945B2

(12) United States Patent
Taylor et al.

(10) Patent No.: US 8,032,945 B2
(45) Date of Patent: Oct. 11, 2011

(54) SUBMARINE ESCAPE SUITS

(75) Inventors: Richard C. Taylor, Ruthin (GB); Steve Littler, Moreton (GB); Robert J Prendergast, Bootle (GB)

(73) Assignee: Survitec Group Limited (GB)

( * ) Notice: Subject to any disclaimer, the term of this patent is extended or adjusted under 35 U.S.C. 154(b) by 106 days.

(21) Appl. No.: 12/442,352

(22) PCT Filed: Sep. 11, 2007

(86) PCT No.: PCT/GB2007/003432

§ 371 (c)(1),
(2), (4) Date: Apr. 28, 2009

(87) PCT Pub. No.: WO2008/035036

PCT Pub. Date: Mar. 27, 2008

(65) Prior Publication Data

US 2010/0024087 A1 Feb. 4, 2010

(30) Foreign Application Priority Data

Sep. 21, 2006 (GB) ..... 0618628.2

(51) Int. Cl.
*B63C 11/04* (2006.01)
*B63C 11/00* (2006.01)

(52) U.S. Cl. ..... 2/2.17; 2/2.11; 2/2.14; 2/227

(58) Field of Classification Search ..... 2/69, 82, 2/456, 458, 227, 269, 914, 2.11–2.17
See application file for complete search history.

(56) References Cited

U.S. PATENT DOCUMENTS

| | | | |
|---|---|---|---|
| 1,878,434 | A | 9/1932 | Belloni |
| 2,383,261 | A | 8/1945 | Kronhaus |
| 2,911,649 | A | 11/1959 | Ruelle et al. |
| 3,107,373 | A | 10/1963 | Mellon |
| 3,391,405 | A | 7/1968 | Wiswell |
| 3,444,570 | A | 5/1969 | Smith |
| 3,902,327 | A | 9/1975 | Guillerm |
| 3,925,839 | A | 12/1975 | Smith |
| 3,969,903 | A | 7/1976 | Boisrayon |
| 4,136,402 | A | 1/1979 | Insulan et al. |
| 4,227,262 | A | 10/1980 | Insulan et al. |
| 4,294,242 | A | 10/1981 | Cowans |
| 4,599,075 | A | 7/1986 | Nygard |

(Continued)

FOREIGN PATENT DOCUMENTS

DE 20308642 7/2004

(Continued)

OTHER PUBLICATIONS

U.S. Appl. No. 12/442,370, filed Mar. 20, 2009, Taylor.

(Continued)

*Primary Examiner* — Bobby Muromoto, Jr.
(74) *Attorney, Agent, or Firm* — Workman Nydegger

(57) ABSTRACT

A submarine escape suit is made longitudinally adjustable by elastic adjustment members (20*a*, 20*b*) that extend along the sides of the suit between the ankle region and the arms of the suit. This provides a long adjustment length which allows a wide range of wearer heights to be accommodated. The members (20*a*, 20*b*) are encased in non-snag covers (29). A central adjustment strap (21) is also provided and is also partially encased in a non-snag cover (35).

19 Claims, 3 Drawing Sheets

U.S. PATENT DOCUMENTS

Figure 1:
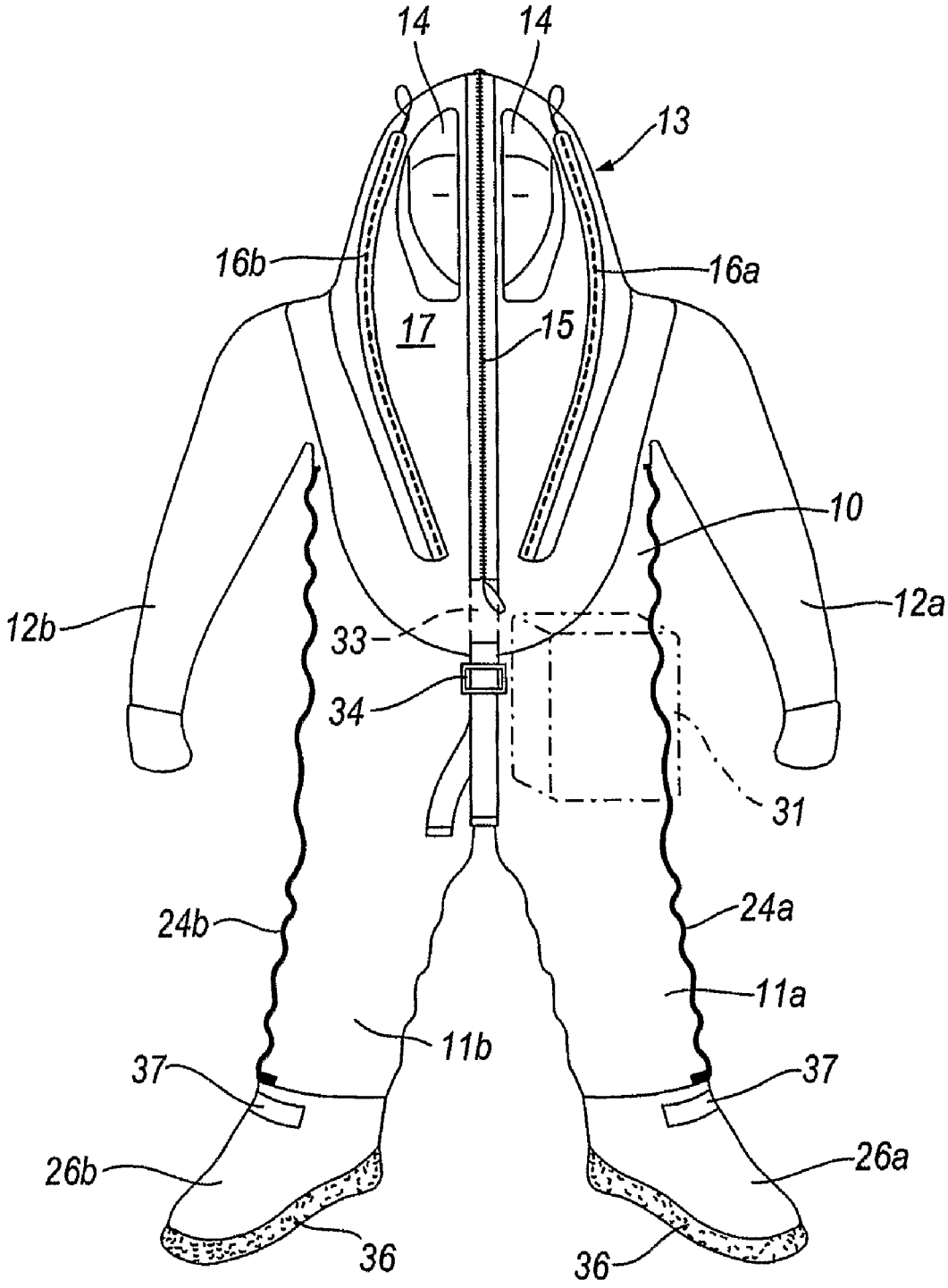

| | | | | |
|---|---|---|---|---|
| 4,734,072 | A | 3/1988 | Lastnik | |
| 4,773,101 | A | 9/1988 | Kapp et al. | |
| 5,067,921 | A | 11/1991 | Bramham | |
| 5,127,896 | A | 7/1992 | De Gaston | |
| 5,324,219 | A * | 6/1994 | Beltrani et al. | 441/64 |
| 5,367,709 | A | 11/1994 | Teasley | |
| 6,357,048 | B2 | 3/2002 | Griffiths | |
| 6,659,689 | B1 | 12/2003 | Courtney et al. | |
| 6,860,775 | B2 | 3/2005 | Buzzetti | |
| 6,976,894 | B1 | 12/2005 | Turner | |
| 7,900,573 | B2 | 3/2011 | Prendergast | |
| 2001/0008027 | A1 | 7/2001 | Duplock | |
| 2001/0047530 | A1 | 12/2001 | Griffiths | |
| 2003/0024028 | A1 | 2/2003 | Sleesen | |
| 2004/0031090 | A1 | 2/2004 | Duncan | |
| 2004/0033739 | A1 | 2/2004 | Courtney | |
| 2004/0237178 | A1 | 12/2004 | Landeros | |
| 2007/0151593 | A1 | 7/2007 | Jaynes | |
| 2009/0139440 | A1 * | 6/2009 | Prendergast et al. | 114/336 |
| 2009/0301377 | A1 * | 12/2009 | Taylor et al. | 114/336 |
| 2009/0313747 | A1 * | 12/2009 | Taylor et al. | 2/456 |

FOREIGN PATENT DOCUMENTS

| | | | |
|---|---|---|---|
| EP | 0444400 | | 9/1991 |
| EP | 0992423 | | 4/2000 |
| EP | 1352577 | | 10/2003 |
| FR | 2282365 | | 3/1976 |
| FR | 2823954 | | 10/2002 |
| GB | 486479 | | 4/1937 |
| GB | 2069416 | | 8/1981 |
| GB | 2330517 | | 4/1999 |
| GB | 2342277 | | 4/2000 |
| GB | 2342277 | A * | 4/2000 |
| GB | 2358341 | | 7/2001 |
| GB | 2438606 | A * | 12/2007 |
| JP | 2001303315 | | 10/2001 |
| JP | 2004052119 | | 2/2004 |
| JP | 2004143648 | | 5/2004 |
| WO | WO8403266 | | 8/1984 |

OTHER PUBLICATIONS

U.S. Appl. No. 12/442,370, Mail Date Apr. 29, 2010, Office Action.

U.S. Appl. No. 12/442,370, Mail Date Dec. 30, 2010, Office Action.

U.S. Appl. No. 12/442,370, Mail Date Mar. 21, 2011, Interview Summary.

* cited by examiner

SUBMARINE ESCAPE SUITS

The invention relates to submarine escape suits.

A submarine escape suit is made from a flexible material and comprises a body portion, left and right leg portions and left and right arm portions. There is generally also a hood that covers the head and face of a wearer. Such suits are used to escape from submerged submarines in emergency situations. The suit is donned and the wearer enters an escape chamber where air is supplied to the suit from within the submarine, the chamber fills with water and the hatch opens to allow the wearer to ascend to the surface breathing the air within the suit.

It is a problem with such suits that they are required to fit wearers with a wide range of different heights. It has been proposed to provide means for shortening, for example, the leg portions or constricting the shoulders or back of the suit but this does not address fully the problem.

According to the invention, there is provided a submarine escape suit made from a flexible material and comprising a body portion, left and right leg portions and left and right arm portions and an elastic adjustable member extending from a first point on the suit adjacent an ankle of the wearer to the second point on the suit adjacent to the arm of the wearer to contract the suit between the points to allow a suit to fit wearers of differing heights.

By attracting the suit over such a long length of the suit the suit will fit a wider range of heights.

The following is a more detailed description of an embodiment of the invention, by way of example, reference being made to the accompanying drawings in which:—

Figure 2:
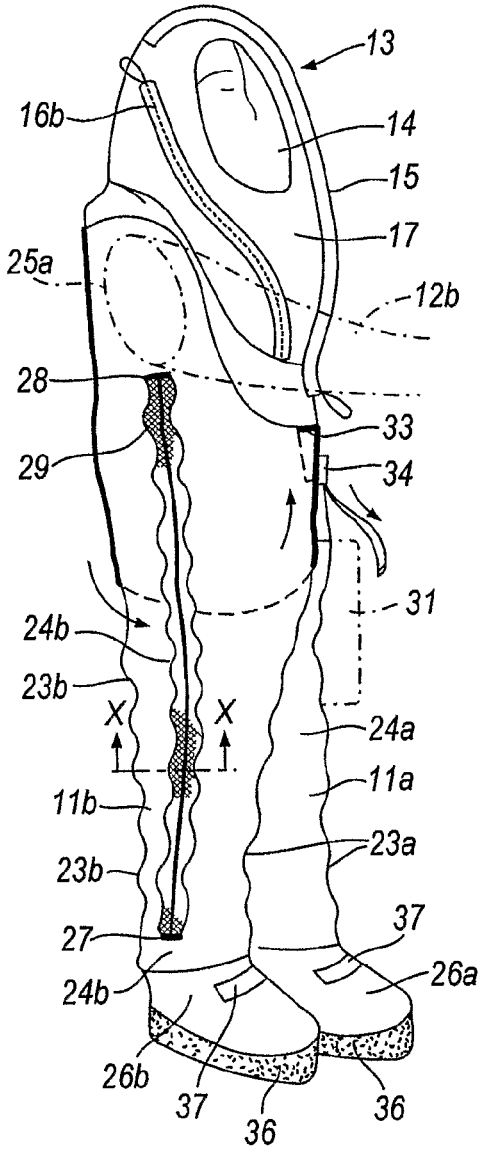
Figure 3:
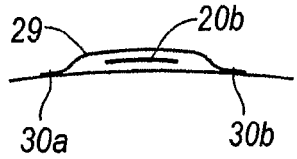
Figure 4:
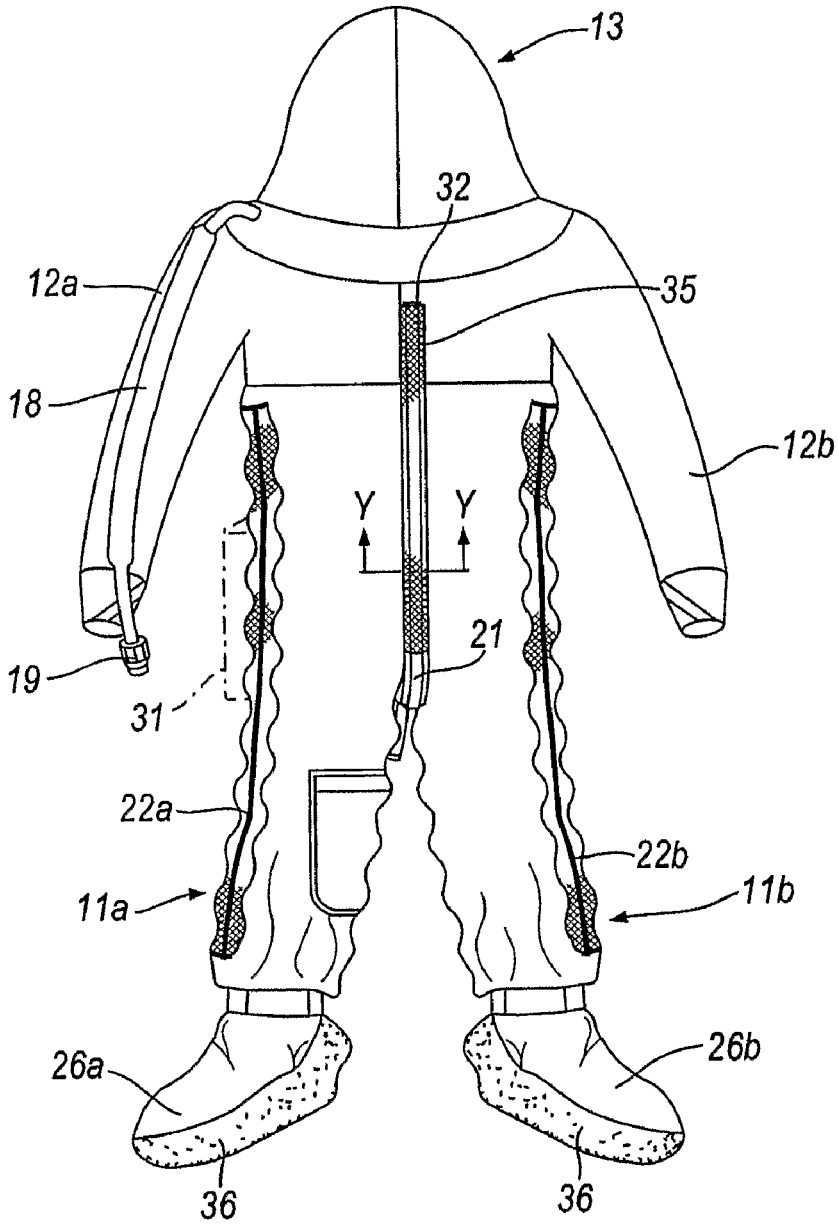
Figure 5:
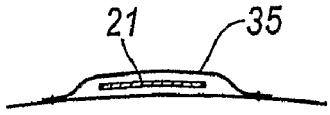

FIG. 1 is a front elevation of a submarine escape suit including two elastic adjustment members and an adjustment strap, FIG. 2 is a side elevation of the submarine escape suit of FIG. 1, FIG. 3 is a cross-section on the line XX of FIG. 2, FIG. 4 is a rear elevation of the submarine escape suit of FIGS. 1 and 2, and FIG. 5 is a cross-section on the line YY of FIG. 4.

The submarine escape suit is formed from a waterproof flexible material such as a rubberised fabric or a plastics coated fabric. The suit is formed with a body portion 10, leg and right leg portions 11*a*, 11*b* and left and right arm portions 12*a*, 12*b*. Each leg portion 11*a*, 11*b* has front and rear surfaces 23*a*, 23*b* for covering the front and rear of the wearers leg and inner and outer surfaces 24*a*, 24*b* covering the inner leg and outer leg of a wearer. Each arm portion 12*a*, 12*b* joins the body portion around a respective armhole 25 (see FIG. 2). In addition, the suit includes a hood 13 provided with translucent panels 14, a central zip 15 to allow access to the suit and releasable side connections 16*a*, 16*b* that allow a central face panel 17 to be lifted away from the face of a wearer. The construction of the hood 13 is described more fully in our co-pending UK patent application no. 0618632.4. An air supply tube 18 (see FIG. 4) of conventional type runs along the left arm portion 12*b* between a connector 19 and the interior of the hood 13.

The suit is completed by foot coverings in the form of left and right boots 26*a*, 26*b*. These will be described in more detail below.

Two elastic adjustment members 20*a*, 20*b* are provided on the suit. In construction, the two elastic adjustment members 20*a*, 20*b* are identical and so only one of these members, the right hand member 20*b*, will be described in detail. The right hand elastic adjustment member 20*b* is an elongate elastic strip that is fixed to the suit at two spaced points. The first point 27 is on the outer surface 24*b* of the associated leg portion 11*b* towards the lower end of the leg portion 11*b* in the region of an ankle of a wearer. The second point 28 is, as seen in FIG. 2, adjacent the associated armhole 25*b*. The elastic strip 20*b* is encased in a tube formed by an elongate cover 29 and the material of the suit. The elongate cover 29 extends over the elastic strip 20*b* and has spaced side edges connected to the material along connection lines 30*a*, 30*b* (see FIG. 3). The connection may be by stitching. The cover 29 is preferably formed by a non-snag netting material to allow easy drainage of water. In assembly, the cover 29 is connected to the suit, the elastic strip 22 connected to one of the points 27, 28, fed through the tube formed between the cover 29 and the suit and then attached to the other of the points 28, 27.

When both elastic strips 20*a*, 20*b* are assembled in this way, they are in tension. Accordingly, the elastic strips 22 draw the first and second points 27, 28 together so shortening the length of the suit between the armholes 25*a*, 25*b* and the ends of the left and right leg portions 11*a*, 11*b*. The tension may be chosen to provide a required degree of extension—for example 0.3 m to 0.7 m.

The suit may also include a liferaft shown in broken line at 31. The liferaft is for use by a wearer on reaching the sea surface, when the liferaft is inflated and deployed before being boarded by the wearer. Such liferafts are known from, for example, EP-A-0444400.

The suit also includes a strap 21 is formed from a band of inflexible material. The strap 21 extends from a first point 32 on the back of the body portion 10 towards an upper end of the back portion 10 through the crotch region between the left and right leg portions 11*a*, 11*b* to a second point 33 on the front of the body portion 10 towards the lower end of the hood 13. This strap 21 includes an adjustment buckle 34. As seen in FIG. 5, the strap 21 is encased in a tube formed between the material of the suit and an elongate second cover 35. The second cover 35 is constructed and arranged as the first cover 29 described above. The cover 35 extends from the first point 32 to a point adjacent the lower edge of the body portion 10.

The left and right boots 26*a*, 26*b* are identical and so only one, the left hand boot 26*a*, will be described in detail.

The left hand boot 26*a* is formed of a flexible waterproof material and is connected to the associated left leg portion 11*a*. The boot 26*a* is provided with a non-slip sole 36. In addition, a VELCRO strap extends across the front of the boot 26*a* to allow the boot 26*a* to be tightened around the ankle of a wearer.

In use the suit is packed in a valise and stored in a submarine for emergency use. In use, the suit is taken from the valise and the zip 15 in the hood 13 undone. The wearer then climbs into the suit through the aperture formed by the open zip 15 inserting arms and legs into the arm and leg portions 11*a*, 11*b*, 12*a*, 12*b* as appropriate. The wearer's feet enter the left and right boots 26*a*, 26*b* and the suit is arranged around the shoulders of the wearer. In doing this, the suit is extended against the action of the elastic strips 22 between the first and second points 27, 28. The very long distance between these points allows a wide range of adjustment ensuring that both the body portion 10 and the left and right leg portions 11*a*, 11*b* fit comfortably. The strap 22 can be adjusted using the buckle 34 to ensure that excess material between the crotch of a wearer and the crotch of the suit is gathered up. The wearer also tightens the flaps 37 around the boots 26*a*, 26*b* to ensure that the boots fits the wearer snugly.

The wearer then enters an escape chamber and connects the connector 19 to the air supply system of the submarine. This passes air into the suit and more particularly into the hood 13. When the chamber has been filled with water, a hatch opens and a wearer exits the chamber. The provision of the non-snag covers 29 and 35 reduces the possibility of the suit snagging on equipment within the chamber and preventing exit.

The wearer then rises to the surface breathing air within the hood 13. At the surface, the wearer floats on his/her back and the liferaft 31 can be deployed, inflated and boarded. The fit between the suit and the wearer ensures that the suit is comfortable to wear and does not have significant volumes of excess material that inhibit floating or swimming.

The tight fit of the suit also ensures that the feet of the wearer do not leave the boots 26*a*, 26*b* while the wearer is manovering on the water surface.

It will be appreciated that there are a number of alterations that can be made to the submarine escape suit described above with reference to the drawings.

There need not be two elastic adjustment members 20*a*, 20*b*, there could be one or three or more. The elastic adjustment member or members 20*a*, 20*b* need not be connected between the first and second points 27, 28 shown in the drawings; they could be connected at different points. For example, they could be connected between a respective boot 26*a*, 26*b* and the shoulders of the body portion 10. In addition, the elastic adjustment members 20*a*, 20*b* need not extend up the sides of the suit; they could extend up the front of the suit or the back of the suit.

The member 20*a*, 20*b* should, in whatever configuration, extend from the ankle region of the suit to the arm region to provide a wide range of adjustment.

While the covers 29, 35 are preferably made from a non-snag netting; they could be made from any suitable material. The covers 29, 35 need not be stitched to the suit, they could be glued or welded. The strap 21 need not be unextendable, it could be formed from a non-elastic material. There could be an additional cover over the strap 22 at the front of the body portion 10. The adjustment of the strap 21 need not use a buckle; it could use another form of adjustment such as a VELCRO™ strip.

The invention claimed is:

1. A submarine escape suit made from a flexible material and comprising a body portion, left and right leg portions and left and right arm portions, and an elastic adjustment member extending from a first point on the suit adjacent an ankle of a wearer to a second point on the suit adjacent an arm of a wearer, the adjustment member having a first contracted disposition in which the first and second points are drawn together to provide a shortened length between said first and second points and a shortened length of both the leg portions and the body portion, and the adjustment member having a first extended position in which the distance between said first and second points is increased to provide increased length of the leg portions and the body portion to fit the suit to wearers of differing heights.

2. A suit according to claim 1 wherein each leg portion has front and rear surfaces for covering the front and rear of a leg of a wearer and inner and outer surfaces for covering the inner leg and outer leg of a wearer, the first point being on said outer surface of a leg portion.

3. A suit according to claim 1 wherein each arm portion joins the body portion around an arm hole, the second point being adjacent a lower edge of said arm hole.

4. A suit according to claim 3 wherein the adjustment member, when the suit is on a wearer, extends in a straight line between the first and second points.

5. A submarine escape suit made from a flexible material and comprising a body portion, left and right leg portions and left and right arm portions, and an elastic adjustment member extending from a first point on the suit adjacent an ankle of a wearer to a second point on the suit adjacent an arm of a wearer to contract the suit between the points to allow the suit to fit wearers of differing heights, wherein the adjustment member is enclosed in a tube extending between the first and second points and fixed relative to the suit to ensure even contraction of the suit by the elastic adjustment member, and wherein the tube is formed by an elongate cover and the material of the suit, the elongate cover extending over the adjustment member and having spaced side edges connected to said material.

6. A suit according to claim 5 wherein the cover is formed from a non-snag material.

7. A suit according to claim 1 wherein a second elastic adjustment member is provided at a position on the portions spaced from the first-mentioned elastic adjustment member.

8. A suit according to claim 7 wherein each leg portion has front and rear surfaces for covering the front and rear of a leg of a wearer and inner and outer surfaces for covering the inner leg and outer leg of a wearer, each arm portion joining the body portion around on arm hole, the first point being on the outer surface of the left leg and the second point being adjacent a lower edge of the left arm hole, the second elastic adjustment member extending from a third point on the outer surface of the right leg adjacent on ankle of the wearer to a fourth point adjacent a lower edge of the right arm hole.

9. A suit according to claim 1 wherein the body portion has a back and a front, an adjustable strap extending from a point on the back of the body portion, between the leg portions to a point on the front of the body portion, the strap allowing adjustment of the suit between a lower end of the body portion and said points.

10. A suit according to claim 9 wherein the back point and the front point are towards an upper end of the body portion.

11. A suit according to claim 9 wherein the strap is inextensible.

12. A suit according to claim 11 wherein the strap includes a buckle to allow adjustment of the length of the strap.

13. A suit according to claim 9 wherein at least the portion of the strap extending across the back of the body portion is enclosed in a tube extending from said back point and fixed relative to the suit to ensure even contraction of the back of the body portion.

14. A suit according to claim 13 wherein the tube is formed by an elongate cover and the material of the suit, the elongate cover extending over the strap and having spaced side edges connected to the material.

15. A suit according to claim 14 wherein the cover is formed from a non-snag material.

16. A suit according to claim 1 and further comprising left and right foot coverings each attached to a respective leg portion.

17. A suit according to claim 16 wherein each foot covering has a non-slip sole.

18. A suit according to claim 16 wherein each foot covering includes adjustment means for tightening the associated foot covering around an ankle of a wearer.

19. A submarine escape suit of flexible material, comprising:

a body portion;

a hood attached to the body portion;

left and right leg portions connected to the body portion;

left and right arm portions connected to the body portion;

a first cover attached to the suit and cooperating with the flexible material of the suit to define a first tube;

a second cover attached to the suit and cooperating with the flexible material of the suit to define a second tube;

a first elastic adjustment member attached directly to the suit and extending from an end point on the suit adjacent a first ankle of a wearer to an end point on the suit adjacent a first arm of the wearer, the first elastic adjustment member being substantially confined in the first tube; and a second elastic adjustment member attached directly to the suit and extending from an end point on the suit adjacent a second ankle of the wearer to an end point on the suit adjacent a second arm of the wearer, the second elastic adjustment member being substantially confined in the second tube, wherein each of the adjustment members has:

a contracted disposition in which the respective end points are drawn together to provide a shortened length therebetween and a shortened length of both the leg portions and the body portion; and an extended disposition in which the distance between the respective end points is increased to provide increased length of the leg portions and the body portion to fit the suit to fit wearers of differing heights.

* * * * *

UNITED STATES PATENT AND TRADEMARK OFFICE

CERTIFICATE OF CORRECTION

PATENT NO. : 8,032,945 B2
APPLICATION NO. : 12/442352
DATED : October 11, 2011
INVENTOR(S) : Taylor et al.

It is certified that error appears in the above-identified patent and that said Letters Patent is hereby corrected as shown below:

Title Page, Item (75)
Inventors:, change "Ruthin (GB)" to --Llanbedr (GB)--

Drawings
Sheet 3, replace Figure 4 with the figure depicted below, wherein "22a" is changed to --20a-- and "22b" is changed to --20b--

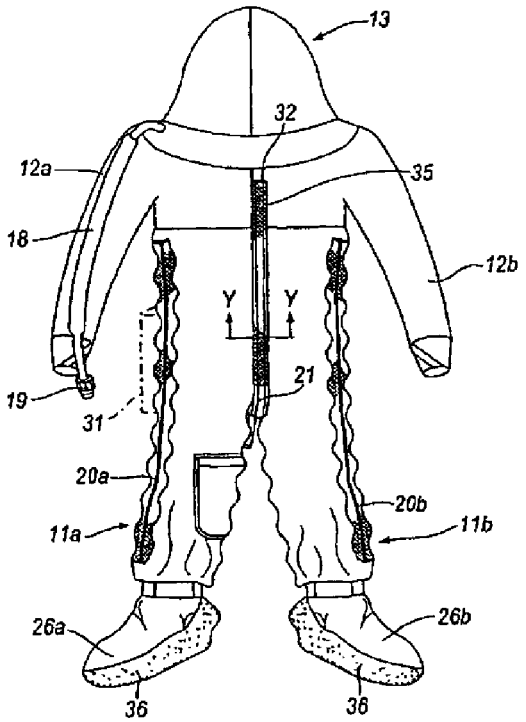

Fig.4

Signed and Sealed this
Twenty-seventh Day of March, 2012

David J. Kappos

David J. Kappos
*Director of the United States Patent and Trademark Office*

Column 1
Line 31, change “which:-” to --which:--
Line 43, change “leg” to --left leg--

Column 2
Line 12, change “elastic strip 22” to --elastic strip 20b--
Line 16, change “strips 22” to --strips 20a, 20b--
Line 22, change “in” to --in a--
Line 27, delete “is”
Line 55, change “elastic strips 22” to --elastic strips 20a and 20b--
Line 59, change “strap 22” to --strap 21--